US007102536B2

(12) United States Patent
Scholz

(10) Patent No.: US 7,102,536 B2
(45) Date of Patent: Sep. 5, 2006

(54) MICROWAVE VEHICLE-TO-VEHICLE WARNING SYSTEM

(76) Inventor: John Arthur Scholz, De Poorterstraat 31, Den Haag (NL) 2597 CR ( * ) Notice: Subject to any disclaimer, the term of this patent is extended or adjusted under 35 U.S.C. 154(b) by 220 days.

(21) Appl. No.: 10/746,692

(22) Filed: Dec. 29, 2003

(65) Prior Publication Data

US 2004/0145494 A1 Jul. 29, 2004

Related U.S. Application Data

(60) Provisional application No. 60/438,536, filed on Jan. 8, 2003.

(51) Int. Cl.
*G08G 1/00* (2006.01)

(52) U.S. Cl. ..... 340/902; 340/901; 340/903; 340/904

(58) Field of Classification Search ..... 340/902, 340/901, 903, 904; 455/575.9
See application file for complete search history.

(56) References Cited

U.S. PATENT DOCUMENTS 4,700,191 A * 10/1987 Manor ..... 342/13
5,559,508 A * 9/1996 Orr et al. ..... 340/902
5,815,092 A * 9/1998 Gregg et al. ..... 340/936
5,917,430 A * 6/1999 Greneker et al. ..... 340/905

* cited by examiner

*Primary Examiner*—Donnie L. Crosland
(74) *Attorney, Agent, or Firm*—Maier & Maier, PLLC

(57) ABSTRACT

A microwave vehicle-to-vehicle signaling device that converts microwave warning signals transmitted by a first vehicle into control signals in a second vehicle that are suitable for controlling audio devices or displays in such a way that the warning signals are perceived by the driver of a second vehicle to originate from the direction and distance of the first vehicle. Receiving vehicles located beyond the defined distance do not react to the warning messages due to the weakness of the signal.

15 Claims, 5 Drawing Sheets

MICROWAVE VEHICLE-TO-VEHICLE WARNING SYSTEM

CROSS-REFERENCE TO RELATED APPLICATIONS

Reference is made to provisional utility patent application No. 60/438,536 entitled "Microwave alerting system for vehicles" filed by John A. Scholz on 8 Jan. 2003 with the USPTO.

STATEMENT REGARDING FEDERALLY SPONSORED RESEARCH OR DEVELOPMENT

I certify that the invention described in this utility patent application has been developed privately and has no relation whatsoever to any federally sponsored research or development programs.

REFERENCE TO A SEQUENCE LISTING, A TABLE, OR A COMPUTER PROGRAM LISTING COMPACT DISK APPENDIX

Not Applicable.

BACKGROUND OF THE INVENTION

The invention relates to a microwave vehicle-to-vehicle signaling device that uses an electronic warning signal impressed on a microwave signal in order to provide two-way communications among vehicles. The microwave signaling device transmits and receives warning signals, and provides electronic control signals for controlling visible and audible warning indications to the driver of a vehicle in response to the electronic warning signal.

One way to reduce traffic noise and improve the effectiveness of warning signals exchanged among vehicles is to equip each vehicle with a microwave vehicle-to-vehicle signaling device that is capable of both transmitting warning signals by means of a microwave signal and receiving warning signals from other vehicles by means of a microwave signal. The microwave vehicle-to-vehicle signaling device transforms received microwave signals into control signals that are suitable for controlling devices for producing sounds, for example the sound of an automobile horn that is generated by means of speakers arranged around a driver of a vehicle. The amplitude of the sound from each speaker is controlled by the signaling device in such a way as to provide an indication of the direction to the origin of the received warning signals. The amplitude and frequency of the sound from each speaker is also controlled by the signaling device in such a way as to provide an indication of the distances to vehicles that are transmitting warning signals. The sounds are generated within the vehicle at an amplitude that is inaudible or nearly inaudible outside of the vehicle. The microwave vehicle-to-vehicle signaling device also produces control signals that are suitable for controlling lamps or displays located within the field of view of the driver of each receiving vehicle, which provides assistance to drivers with hearing difficulties.

One object of the invention is to reduce or eliminate noise due to audible vehicle-to-vehicle signaling devices by confining most or all audible warning sounds, for example those produced by automobile horns, to the passenger compartment of each vehicle. The effective range of a warning signal transmission is limited by atmospheric absorption and by the transmitted signal power.

Another object of the invention is to provide control signals that are suitable for producing sounds within a vehicle by controlling a set of audio speakers or other sound producing devices in such a way as to allow the driver to determine the general directions and relative distances of microwave transmitters that are transmitting the warning signals.

Another object of the invention is to increase the effectiveness of audible police vehicle or emergency vehicle warning signals by reducing the ambient noise level in the environment. Alternatively, the invention allows a police vehicle or an emergency vehicle to reduce the amplitude of its audible vehicle-to-vehicle signaling device. The invention reduces the need for police and emergency vehicles to produce high amplitude audible warning signals, which are normally necessary to penetrate closed vehicles and compete with sound from music, conversation, and ambient traffic noise. The ambient traffic noise also includes automobile horn sounds, which would be reduced in amplitude by the invention. The microwave signals produced by the invention are inaudible to humans.

A further object of the invention is to limit the duty cycle and pulse repetition frequency of the microwave vehicle-to-vehicle signaling device, for example to prevent excessive use of the signaling device.

A system for producing automobile horn sounds by synthetic means is described by Solow (U.S. Pat. No. 6,489,885), where a digital counter responsive to clock signals from an oscillator sequentially reads horn audio data from digital memory, which provides the data to a D/A converter and the output audio signal to a speaker for broadcast. Farmer (U.S. Pat. No. 5,979,586) describes a vehicle collision warning system that converts collision threat messages from a predictive collision sensor into intuitive sounds which are perceived by the occupant to be directed from the direction of the potential collision. The collision threat messages are derived from a range sensing circuit, for example a radar set mounted in the vehicle, and they are not transmitted from a second vehicle. Settles (U.S. Pat. No. 5,933,074) describes a radio transmitter that operates in conjunction with a microwave (RF) receiver installed in a vehicle to unlock the doors of the vehicle when a unique RF signal is broadcast within a defined range, and actuate the horn of the vehicle when the same RF signal is broadcast outside of the defined range. The radio transmitter is hand held and is typically carried on a key chain, and it actuates an audible horn sound from a single remote vehicle, thereby increasing the ambient noise level.

The current invention describes a vehicle-to-vehicle signaling device for two-way communications that converts microwave warning messages sent by transmitting vehicles into control signals that are suitable for controlling devices that produce synthetic, intuitive sounds and displays in receiving vehicles. The sounds and displays are perceived by the drivers of receiving vehicles to be directed from the several directions and relative distances of transmitting vehicles. The range of a transmitted signal is confined to a limited distance around a transmitting vehicle by atmospheric absorption of the electromagnetic wave that carries the transmitted signal, and also by the transmitter power, which is set to a predetermined level. Receiving vehicles located beyond a limited distance from a transmitting vehicle do not react to the microwave warning messages due to the weakness of the signal. Vehicles that receive the microwave warning messages are also capable of transmitting microwave warning messages.

The purpose of the invention is to reduce the ambient noise level in the environment by reducing the noise produced by automobile horns and other audible vehicle-to-vehicle signaling devices, and also to improve the effectiveness of warning signals exchanged among vehicles.

BRIEF SUMMARY OF THE INVENTION

The invention consists of a microwave transceiver and a multiple channel controller.

The microwave transceiver generates and transmits warning signals by means of microwave frequency electromagnetic waves that are modulated to carry information. The microwave transceiver also intercepts the electromagnetic wave from any other transmitting microwave transceiver within a limited distance and converts it into control signals that are suitable for controlling sound or light producing devices.

The transmitting part of the microwave transceiver consists of a waveform generator for producing electronic warning signals, a modulator for impressing electronic warning signals onto an electronic carrier signal, an amplifier for increasing the power of the modulated electronic carrier signal, and an antenna designed to convert the modulated electronic carrier signal into an electromagnetic wave and radiate the electromagnetic wave within a defined solid angle.

The antenna is designed according to common practice to both transmit and receive the electromagnetic wave. It consists of a cluster of microwave transmitting and receiving elements, with each one pointed in a different direction in azimuth, preferably at equal intervals in angle. In a preferred embodiment of the invention, the antenna consists of a cluster of four microwave transmitting and receiving elements pointed in directions that are separated by 90 degrees in azimuth. When receiving, the antenna provides separate electronic warning signals on a number of separate electrical channels. The number of channels is equal to the number of elements in the cluster of microwave transmitting and receiving elements, and each element of the cluster provides signals to one electrical channel. For example, a cluster of four microwave transmitting and receiving elements produces four separate electrical channels for carrying electronic warning signals. When transmitting, the antenna accepts at least one input signal to be transmitted over all of the elements in the cluster simultaneously.

The receiving part of the microwave transceiver consists of the antenna, which receives the electromagnetic wave from within a defined solid angle and converts it into a modulated electronic carrier signal, an amplifier for increasing the power of the modulated electronic carrier signal, and a demodulator for retrieving electronic warning signals from the modulated electronic carrier signal.

The multiple channel controller transforms the electronic warning signals provided by the receiving part of the microwave transceiver into one or more digital or analog control signals that are suitable for controlling an audio system or a display to produce warnings. Each channel of the multiple channel controller is capable of converting the electronic warning signals into separate control signals in order to provide the driver of a vehicle with an intuitive impression of the directions and distances of nearby vehicles that are transmitting warning signals, for example by controlling the amplitude and tone of each speaker in a set of speakers.

When the driver of a first vehicle wishes to signal one or more drivers of other vehicles, the first driver activates a switch, for example the horn button on a steering wheel or the siren switch in a police car. This activates the microwave transceiver, which is mounted for example underneath the roof of the first vehicle.

The microwave transceiver in the first vehicle transmits a microwave warning signal in all directions in azimuth, and preferably within a limited angle in elevation. In a preferred embodiment, the elevation angle is confined by the design of the transceiver antenna to within several degrees of the plane of the road. Humans cannot hear microwave signals, but setting limits on the elevation angle conserves power. The receiving part of the microwave transceiver in the first vehicle is switched off temporarily during the time of the transmission to prevent the first vehicle from reacting to its own warning signals.

The microwave transceiver in each vehicle within a limited distance of the first vehicle intercepts the transmitted warning signal from the microwave transceiver of the first vehicle and transforms it into a set of electronic warning signals on separate electrical channels. Microwave transceivers located beyond a limited distance from the first vehicle, for example one hundred meters, do not respond to the microwave warning signal. This is due to the fact that propagation and atmospheric absorption cause the microwave warning signal to attenuate to a level that is not detected by a microwave transceiver that is located beyond a limited distance from the first vehicle.

The multiple channel controller transforms the set of electronic warning signals, provided by the microwave transceiver over separate electronic channels, into digital or analog control signals that are suitable for controlling an audio system or a visible display to produce warnings. The control signals from the multiple channel controller are designed to control an audio system or display in such a way as to give the driver of the vehicle an intuitive impression of the directions and distances and types of vehicles that are transmitting warning signals.

BRIEF DESCRIPTION OF THE SEVERAL VIEWS OF THE DRAWING

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

The invention relates to a vehicle-to-vehicle signaling device that uses an electronic warning signal impressed on a microwave frequency electromagnetic wave in order to provide two-way communications among vehicles. The signaling device allows vehicles to transmit and receive warning signals, and provides electronic control signals for controlling visible and audible warning indications to the drivers of the vehicles in response to the microwave warning signal.

Figure 1:
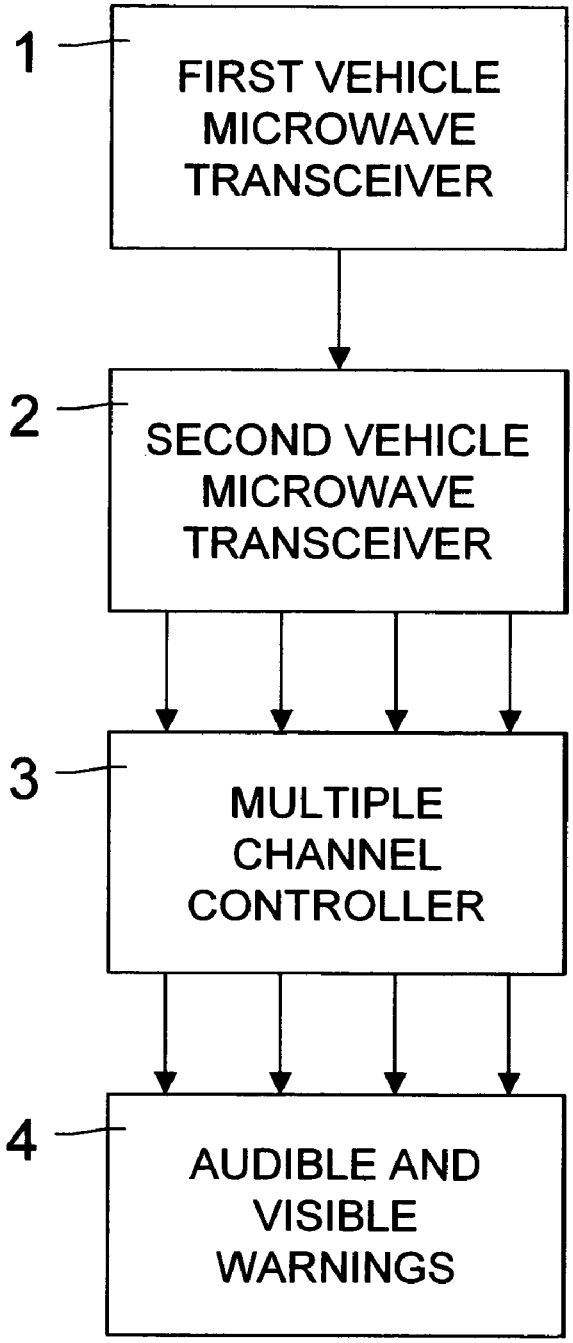
FIG. 1 illustrates the processes according to the invention whereby a microwave transceiver mounted in a first vehicle transmits microwave warning signals that are intercepted by a microwave transceiver mounted in a second vehicle. The microwave transceiver in the second vehicle converts the microwave warning signals into one or more separate electrical channels that carry electronic warning signals. The multiple channel controller in the second vehicle converts the electronic warning signals into one or more control signals that are suitable for controlling audible and visible warnings to the driver of the second vehicle.

FIG. 1 provides an overview of the signaling process. When the driver of a first vehicle wishes to signal the driver of a second vehicle, the driver of the first vehicle activates a switch, for example a horn button, which causes the microwave transceiver 1 in the first vehicle to broadcast a microwave warning signal in all directions in azimuth. A second vehicle located within a limited distance of the first vehicle receives the microwave warning signal by means of the microwave transceiver 2. The microwave transceiver 2 in the second vehicle intercepts the microwave warning signal from the microwave transceiver 1 of the first vehicle and transforms it into a set of electronic warning signals on one or more electrical channels. The multiple channel controller 3 transforms the electronic warning signals provided by the microwave transceiver 2 into digital or analog control signals for controlling audible and visible warnings 4. The control signals for the audible and visible warnings 4 are designed to give the driver of the second vehicle an intuitive impression of the directions and relative distances of all transmitting vehicles, including the first vehicle. The microwave warning signal broadcast by the microwave transceiver 1 is modulated within the microwave transceiver 1 and demodulated within the microwave transceiver 2 in such a way as to prevent random microwave signals in the environment from producing false electronic warning signals within the signaling device, following modulation techniques known in the art. In a preferred embodiment of the invention, the electronic warning signal is unique to a specific type of vehicle, for example to differentiate between ambulances and automobiles.

Figure 2:
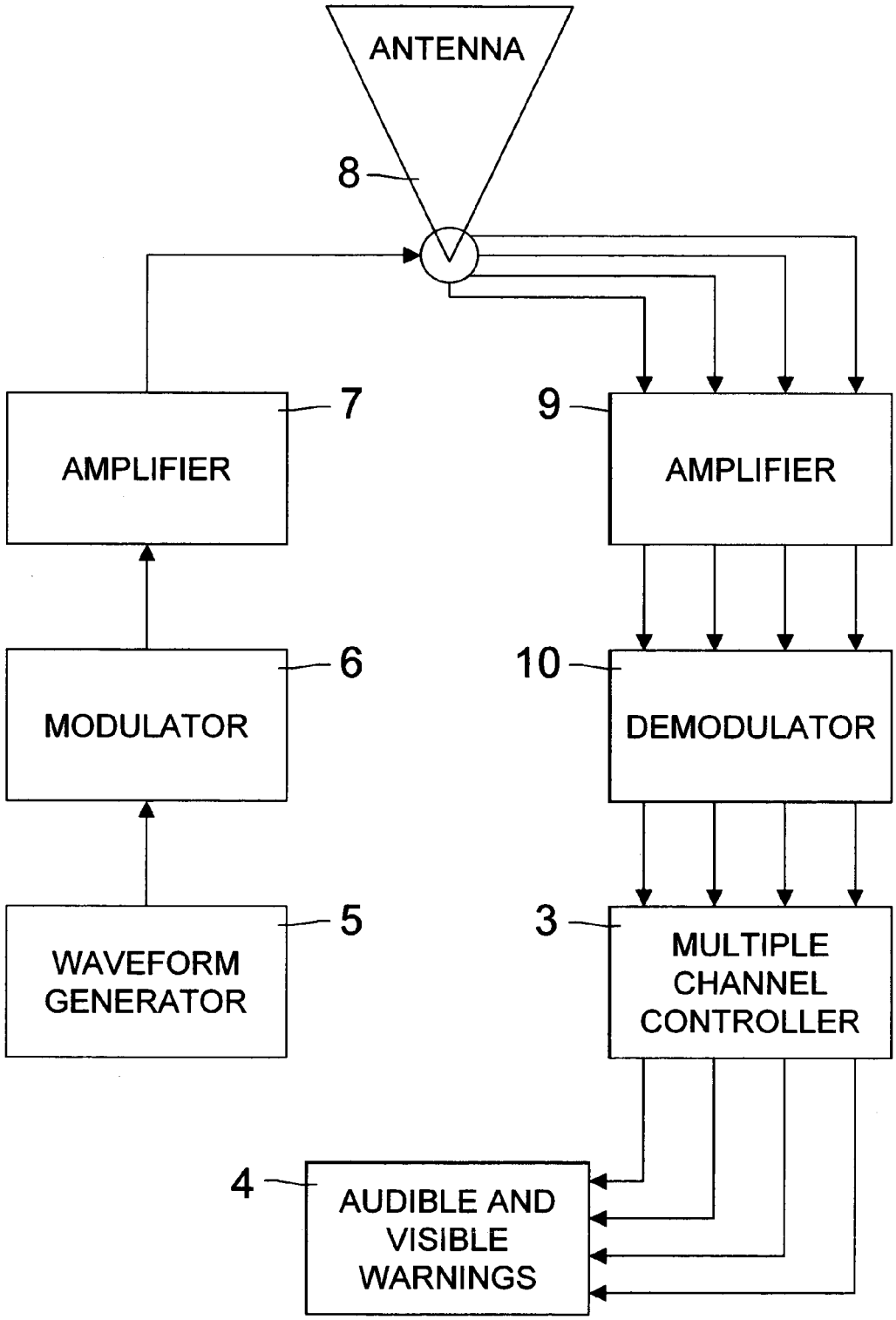
FIG. 2 illustrates the processes according to the invention whereby a microwave transceiver transmits and receives warning signals and a multiple channel controller transforms received warning signals into control signals that are suitable for controlling audio and display devices. Activation of the microwave transceiver by the driver of a first vehicle causes an electronic warning signal to be generated by means of a waveform generator. The electronic warning signal is then impressed onto an electronic carrier signal by means of a modulator, and the modulated electronic carrier signal is amplified by means of an amplifier and then converted into a microwave frequency electromagnetic wave and radiated by means of an antenna. In a preferred embodiment, the antenna is a cluster of four microwave transmit and receive elements arranged in such a way that their directions of maximum sensitivity to the electromagnetic wave are separated equally in azimuth by 90 degrees. The microwave signal radiated by the microwave transceiver in the first vehicle is intercepted by the microwave transceiver in a second vehicle and converted by the antenna in the second vehicle into a set of modulated electronic carrier signals on one or more electrical channels. The modulated electronic carrier signal carried by each electrical channel is produced by one of the microwave elements in the antenna. The modulated electronic carrier signal on each channel is amplified by means of an amplifier and demodulated by means of a demodulator to retrieve the electronic warning signal sent from the first vehicle. The electrical channels produced by the second vehicle microwave transceiver are processed by the multiple channel controller into control signals that are suitable for controlling devices that produce audible and visible warnings.

FIG. 2 provides details of the microwave transceiver, which consists of a waveform generator 5, a modulator 6, an amplifier 7, an antenna 8, an amplifier 9, and a demodulator 10. The waveform generator 5 produces an electronic warning signal according to known practices within the art, for example by changing the phase of a sinusoidal waveform at regular intervals according to a digital code. In a favorable embodiment, waveform generator 5 is designed to limit the duty cycle and the pulse repetition frequency of the electronic warning signal in order to prevent excessive transmissions from the microwave transceiver. A pulse repetition frequency of 2 Hertz and a duty cycle of 20% produces a 100 millisecond signal every half second, for example. In another favorable embodiment, waveform generator 5 generates an electronic warning signal that is unique to a specific type of vehicle, for example an automobile, a police car, or an ambulance. Modulator 6 impresses the electronic warning signal onto an electronic carrier signal, also according to known practices within the art. The amplifier 7 increases the power of the modulated electronic carrier signal, which is then converted into an electromagnetic wave and radiated by means of the antenna 8. In a favorable embodiment of the invention, the antenna 8 is characterized by a single-frequency radiation pattern that is omni-directional in azimuth and limited in elevation to several degrees within the plane of the road. In another favorable embodiment, the antenna 8 is a cluster of four microwave transmit and receive elements arranged in such a way that each element's direction of maximum sensitivity to the microwave warning signal is separated from its nearest neighbors by 90 degrees in azimuth. In another favorable embodiment, the sensitivity of the antenna 8 to the microwave warning signal is characterized by four sensitivity maxima separated equally in azimuth by 90 degrees, with the first sensitivity maximum directed at 45 degrees from the driving direction of the vehicle, and the sensitivity is also characterized by an elevation coverage that extends from the road surface to approximately five degrees above the road surface. A microwave warning signal broadcast from a transmitting microwave transceiver is intercepted by the antenna 8 and converted by the antenna 8 into a set of modulated electronic carrier signals on one or more electrical channels. The modulated electronic carrier signal carried by one electrical channel is produced by one of the microwave elements in the antenna 8 in response to the microwave warning signals incident upon the microwave element. Thus, there is a unique one-to-one correspondence between one electrical channel and one of the microwave elements. The modulated electronic carrier signal on each electrical channel in the receiving microwave transceiver is amplified by means of the amplifier 9 and demodulated by means of the demodulator 10 to produce a replica of the electronic warning signal generated by the waveform generator 5 in the transmitting microwave transceiver. The electrical channels provided at the output of the demodulator 10 are processed by the multiple channel controller 3 into control signals that are suitable for controlling audible and visible warnings 4.

Figure 3:
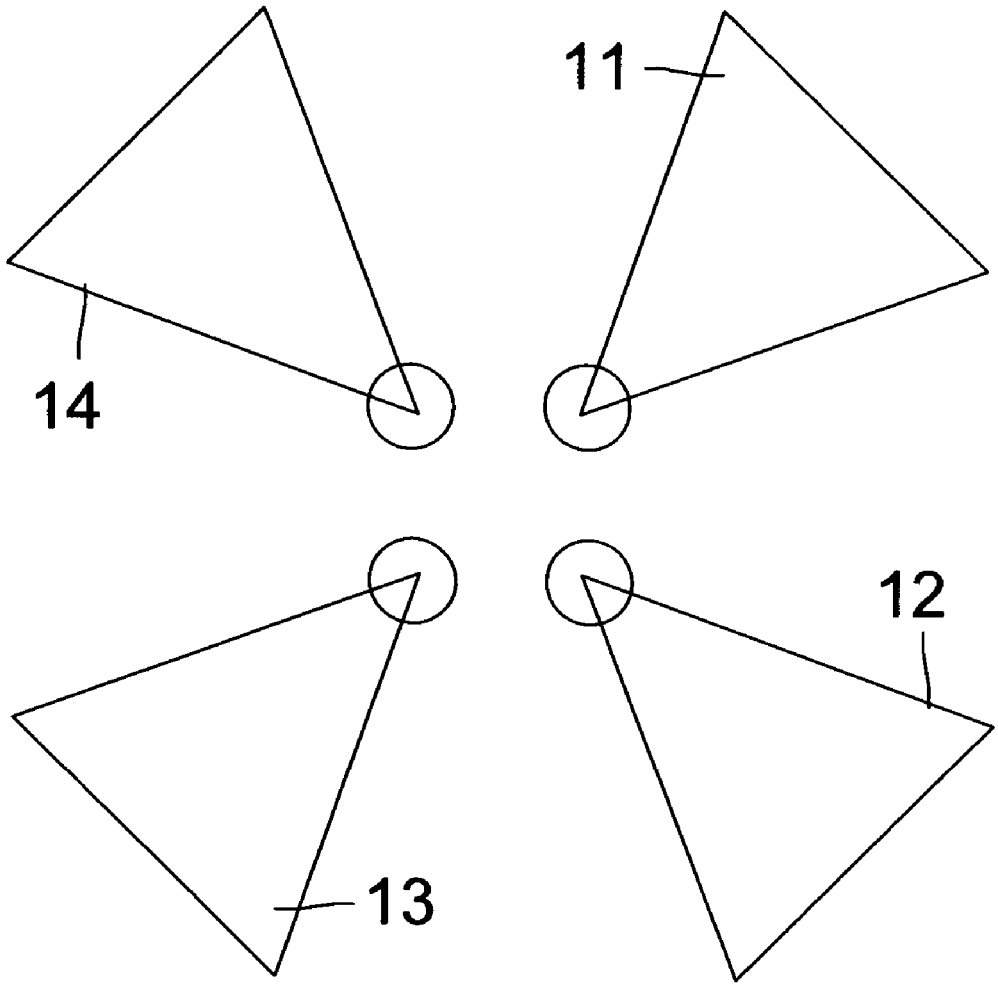
FIG. 3 illustrates a preferred configuration of the antenna, which is constructed as an array of four microwave transmitting and receiving elements pointed at 90 degree intervals in azimuth. Each element provides a single output electrical channel in response to an incoming microwave warning signal, and each element is also capable of transmitting a microwave warning signal. The broadcast pattern of each element is designed in such a way that a uniform broadcast from all four elements taken together produces a microwave warning signal with uniform power in all directions in azimuth.

FIG. 3 illustrates a preferred configuration of the microwave transmitting and receiving elements that make up the antenna. The antenna is constructed as an array of four microwave transmitting and receiving elements 11, 12, 13, and 14 pointed in unique directions that are separated by 90 degrees in azimuth. For example, the microwave transmitting and receiving element 11 is pointed in a direction that is 45 degrees in azimuth from the driving direction of the vehicle in which it is mounted, element 12 is pointed in a direction that is 135 degrees in azimuth from the driving direction of the vehicle, element 13 is pointed in a direction that is 225 degrees in azimuth from the driving direction of the vehicle, and element 14 is pointed in a direction that is 315 degrees in azimuth from the driving direction of the vehicle. Each element responds to the microwave warning signal by producing an electronic warning signal on a single electrical channel. The element that is oriented in the direction that is closest to the direction of the origin of the microwave warning signal produces the strongest response. The remaining elements produce relatively weak responses to the microwave warning signal.

Figure 4:
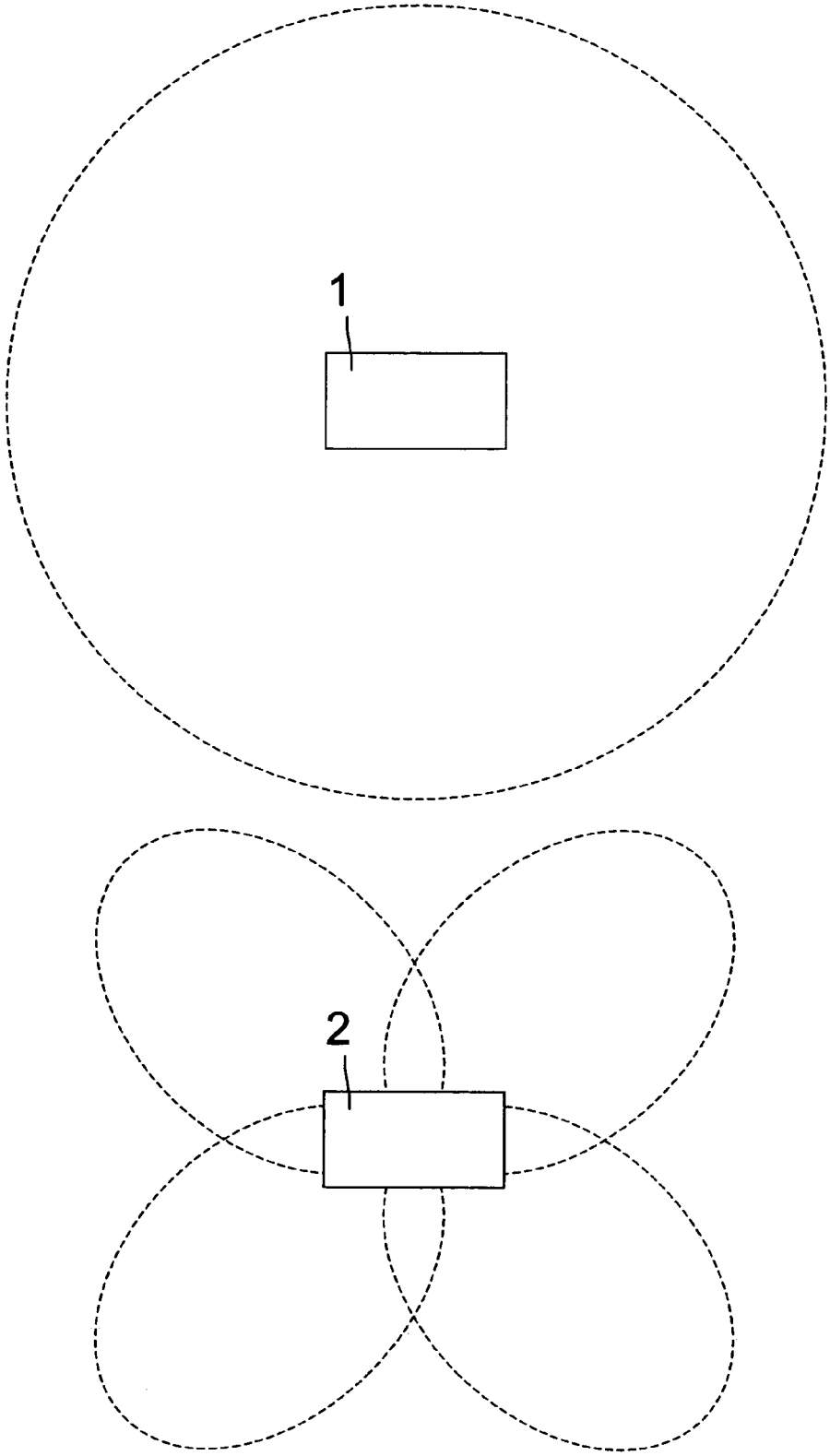
FIG. 4 shows the relative power in all directions in azimuth of the microwave warning signal broadcast by a first vehicle microwave transceiver, and also shows the relative sensitivity to the microwave warning signal of each element in the antenna array of a second vehicle microwave transceiver. Both microwave transceivers are capable of transmitting and receiving microwave warning signals. The microwave warning signal broadcast by the first vehicle microwave transceiver carries warning signals in the form of modulations applied to the wave. The sensitivity to microwave warning signals of the second vehicle microwave transceiver is characterized by four sensitivity lobes with sensitivity maxima spaced equally in azimuth. Upon arrival at the second vehicle, the microwave warning signal broadcast by the first vehicle microwave transceiver causes a response in each of the four microwave elements in the antenna array of the second vehicle microwave transceiver that is proportional to the distance between the two vehicles and also to the angle of arrival of the microwave warning signal at the second vehicle microwave transceiver.

FIG. 4 illustrates the relative power in all directions in azimuth of the microwave warning signal broadcast by a first vehicle microwave transceiver 1, and also the relative sensitivity to the microwave warning signal in all directions in azimuth of a second vehicle microwave transceiver 2, using an example antenna constructed from four transmitting and receiving microwave elements. The relative sensitivity pattern shown for the second vehicle microwave transceiver 2 is achieved for example by means of a simple printed circuit device known in the art as a patch antenna, and it is characterized in this case by four sensitivity lobes that are equally spaced in azimuth. Each sensitivity lobe corresponds to one microwave element in the antenna array. The microwave warning signal broadcast by the first vehicle microwave transceiver 1 carries warning signals in the form of modulations applied to the wave. The microwave warning signal is broadcast with equal power in all directions in azimuth, and confined to a few degrees in elevation. The second vehicle microwave transceiver 2 receives the microwave warning signal in each of its four sensitivity lobes. The relative amplitude of the response in each lobe is determined by the point at which the line of sight between the two microwave transceivers 1 and 2 crosses the lobe, and also by the distance between the microwave transceivers. To provide a uniform power response in all directions in azimuth, the sensitivity lobes overlap in azimuth at the point where their power sensitivities drop to one half of the maximum sensitivity in each lobe. In this way, the amplitude of the response generated by the four sensitivity lobes taken together is always proportional to the distance between the two vehicles, and does not depend on the angle of arrival of the microwave warning signal.

Figure 5:
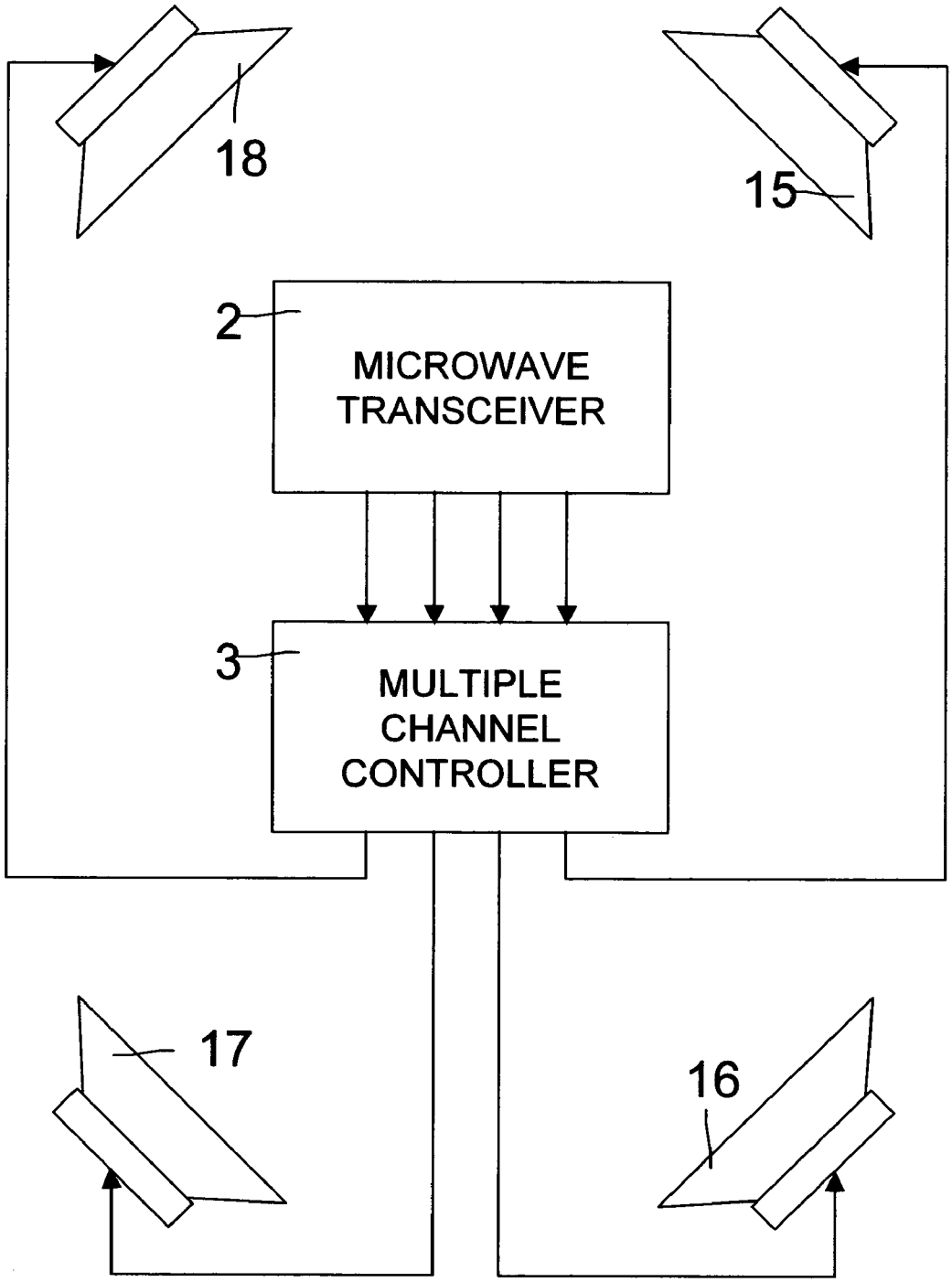
FIG. 5 illustrates the processes according to the invention whereby the multiple channel controller transforms a set of electronic warning signals provided by the microwave transceiver on separate electrical channels into analog or digital control signals for controlling a set of speakers to produce warning sounds.

FIG. 5 illustrates the processes according to the invention whereby a multiple channel controller 3 transforms electronic warning signals provided over multiple electrical channels by a microwave transceiver 2 into control signals that are suitable for controlling a set of audio speakers 15, 16, 17, and 18. The control signals are designed to control the audio speakers in such a way as to provide information about the directions and relative distances to the origins of microwave warning signals received by the microwave transceiver 2. For example, a microwave warning signal that originates from a microwave transceiver that is close to the microwave transceiver 2 and in the direction of the top of the figure results in a high amplitude sound played over audio speakers 15 and 18. A microwave warning signal that originates from a microwave transceiver that is far from the microwave transceiver 2 and in the direction of the right side of the figure results in a relatively lower amplitude sound played over audio speakers 15 and 16. In a preferred embodiment of the invention, the multiple channel controller 3 produces control signals that are capable of reproducing a number of simultaneous sounds through the audio speakers, for example the sound of an automobile horn and the sound of an ambulance siren or the sound of a fire truck siren. An emergency vehicle may be fitted with a microwave transmitter that operates at an increased power level or with a predetermined modulation in order to cause the multiple channel controller 3 to control the audio speakers 15, 16, 17, and 18 in a predetermined and easily recognized manner. Microwave transceivers mounted in different models of automobiles may be designed with unique waveform generators in order to cause the multiple channel controller 3 to control the audio speakers to replay model-specific horn noises, which would help the driver of the receiving vehicle to identify the transmitting vehicle.

The invention claimed is:

1. A vehicle to vehicle warning system comprising:

a plurality of vehicle mounted transceivers configured to allow two way communications;

a plurality of multi-channel controllers connected to the transceivers;

a first vehicle configured to transmit a microwave warning signal to at least one receiving vehicle and the microwave warning being received by the transceiver on at least one receiving vehicle;

wherein the warning signal is transformed by the receiving vehicle transceiver into a set of electronic warning messages on one or more electrical channels and the electronic warning messages on each of the electrical channels are transferred by a multi-channel controller into control signals that are configured to activate at least one of an audible or visible warning;

wherein the audible or visible warning is at least one of activating a horn, activating at least one light or adjusting the volume on the stereo.

2. The vehicle to vehicle warning system according to claim 1 wherein the plurality of transceivers includes a plurality of microwave transmitting and receiving elements.

3. The vehicle to vehicle warning system according to claim 2 wherein the plurality of transmitting elements are configured to transmit in different directions and the plurality of receiving elements are configured to receive from different directions.

4. The vehicle to vehicle warning system according to claim 2 wherein the plurality of microwave transmitting elements are configured to transmit on at least one channel and the plurality of receiving elements are configured to receive on at least two channels.

5. The vehicle to vehicle warning system according to claim 1 wherein the control signals are configured to control the audio speakers to provide directional and distance orientating information about the microwave warning signal received by the microwave transceiver.

6. The vehicle to vehicle warning system according to claim 1 wherein when the microwave warning signal received in the plurality of microwave transmitting and receiving elements is strong in amplitude, the control signal generates a high amplitude sound played over the audio speakers.

7. The vehicle to vehicle warning system according to claim 1 wherein when the microwave warning signals received in the plurality of microwave transmitting and receiving elements is low in amplitude, the control signal generates a low amplitude sound played over the audio speakers.

8. The vehicle to vehicle warning system according to claim 1 wherein the multi-channel controller produces signals that are capable of reproducing a number of simultaneous sounds through the audio speakers.

9. The vehicle to vehicle warning system according to claim 8 wherein the sounds may be at least one of an automobile horn, police car siren, ambulance siren, and a fire truck siren.

10. The vehicle to vehicle warning system according to claim 1 wherein an information-carrying electronic signal containing warning signals is generated by means of a waveform generator and amplified by means of an amplifier and converted to an electromagnetic wave and radiated by means of an antenna array; and wherein electromagnetic waves carrying warning signals that are incident on the antenna array are transformed into one or more electronic signals on one or more electrical channels by means of the antenna array, and the electronic signals are amplified by means of an amplifier; and the electronic warning signals are retrieved from the electrical channels by means of a demodulator.

11. The vehicle to vehicle warning system according to claim 10 wherein the waveform generator generates an electronic warning signal that is unique to a specific type of vehicle.

12. The vehicle to vehicle warning system according to claim 11 wherein the specific type of vehicle is at least one of automobile, a police car, fire truck or an ambulance.

13. The vehicle to vehicle warning system according to claim 10 wherein microwave transceivers mounted in different models of automobiles may generate model-specific waveforms in order to cause the multiple channel controller to control audio speakers to replay model specific horn noises.

14. The vehicle to vehicle warning system according to claim 1, wherein the at least one receiving vehicle displays a visible warning.

15. The vehicle to vehicle warning system according to claim 14, wherein the visible warning on the at least one receiving vehicle is displayed on a display mounted in the receiving vehicle.

* * * * *